US012618355B2

(12) United States Patent
Tendolkar et al.

(10) Patent No.: US 12,618,355 B2
(45) Date of Patent: May 5, 2026

(54) EXHAUST CONDUIT ASSEMBLY

(71) Applicant: Cummins Emission Solutions Inc., Columbus, IN (US)

(72) Inventors: Omkar Tendolkar, Greenwood, IN (US); Thomas Kreser, Lohr (DE); Masoud Ziabakhsh Deilami, Columbus, IN (US); Ralf Rohrmueller, Faulbach (DE); Atif Mahmood, Huddersfield (GB); Joe V. Hill, Columbus, IN (US); Nicholas K. Sharp, Leeds (GB); John G. Buechler, Indianapolis, IN (US); Jim L. Alonzo, Verona, WI (US); Samuel Johnson, East Wenatchee, WA (US)

(73) Assignee: Cummins Emission Solutions Inc., Columbus, IN (US)

( * ) Notice: Subject to any disclaimer, the term of this patent is extended or adjusted under 35 U.S.C. 154(b) by 0 days.

(21) Appl. No.: 18/982,570

(22) Filed: Dec. 16, 2024

(65) Prior Publication Data

US 2025/0116220 A1 Apr. 10, 2025

Related U.S. Application Data

(63) Continuation of application No. PCT/US2023/025152, filed on Jun. 13, 2023.
(Continued)

(51) Int. Cl.
*F01N 13/08* (2010.01)

(52) U.S. Cl.
CPC ..... *F01N 13/08* (2013.01); *F01N 2610/1453* (2013.01)

(58) Field of Classification Search
CPC ..... B01D 2258/012; B01D 53/9431; F01N 3/2066; F01N 2610/1453; F01N 2610/02; F01N 13/08
See application file for complete search history.

(56) References Cited

U.S. PATENT DOCUMENTS 7,603,849 B2 * 10/2009 Hanitzsch ..... F01N 3/2066 239/128
8,943,808 B2 2/2015 Li et al.
(Continued)

FOREIGN PATENT DOCUMENTS

BR 102014031388 A1 1/2021
CN 101988412 A 3/2011
(Continued)

OTHER PUBLICATIONS

Search Report and Written Opinion issued for PCT Application No. PCT/US2023/025152 issued Sep. 8, 2023.

*Primary Examiner* — Anthony Ayala Delgado
(74) *Attorney, Agent, or Firm* — Foley & Lardner LLP

(57) ABSTRACT

An exhaust conduit assembly includes: an exhaust conduit body defining an exhaust flow path; an injection aperture extending through the exhaust conduit body; and a doser mount portion including: an inlet port configured to receive a coolant, a channel configured to receive the coolant from the inlet port, at least a portion of the channel extending around at least a portion of the injection aperture, the channel including a first section and a second section, and an outlet port configured to receive the coolant from the channel. The doser mount portion defines a cavity configured to receive at least a portion of a dosing module and a ridge defines a base of the cavity, wherein the first portion of the channel is disposed adjacent to the cavity and the second portion of the channel is disposed adjacent to the ridge.

19 Claims, 9 Drawing Sheets

Related U.S. Application Data

(60) Provisional application No. 63/353,247, filed on Jun. 17, 2022.

(56) References Cited

U.S. PATENT DOCUMENTS

| | | | | |
|---|---|---|---|---|
| 8,973,355 | B2 * | 3/2015 | Shovels | F01N 3/2066 60/303 |
| 9,091,193 | B2 | 7/2015 | Morey et al. | |
| 9,284,871 | B2 | 3/2016 | Knittel et al. | |
| 9,458,748 | B2 | 10/2016 | David et al. | |
| 9,617,884 | B2 | 4/2017 | Mcfarland et al. | |
| 10,753,253 | B2 * | 8/2020 | Iida | F02M 53/04 |
| 10,767,530 | B2 | 9/2020 | Hanneke | |
| 11,156,141 | B2 | 10/2021 | Short et al. | |
| 2011/0192140 | A1 | 8/2011 | Olivier et al. | |
| 2013/0228231 | A1 * | 9/2013 | Nagel | F02M 53/043 137/334 |
| 2014/0054394 | A1 | 2/2014 | Bugos et al. | |
| 2014/0260207 | A1 * | 9/2014 | Shovels | F01N 3/2066 60/286 |
| 2014/0290222 | A1 | 10/2014 | Sawada et al. | |
| 2015/0068198 | A1 | 3/2015 | Shovels et al. | |
| 2016/0084129 | A1 * | 3/2016 | McFarland | F01N 3/108 60/301 |
| 2017/0175608 | A1 | 6/2017 | Trivedi et al. | |
| 2018/0238217 | A1 | 8/2018 | Devito et al. | |
| 2019/0383187 | A1 * | 12/2019 | Sarsen | F01N 3/2066 |
| 2021/0270171 | A1 * | 9/2021 | Johnson | F15D 1/009 |

FOREIGN PATENT DOCUMENTS

| | | | |
|---|---|---|---|
| CN | 103212285 | B | 7/2013 |
| DE | 10 2019 118 405 | | 1/2021 |
| GB | 2 539 888 | A | 1/2017 |
| GB | 2 552 811 | A | 2/2018 |
| JP | 2004-211635 | A | 7/2004 |
| JP | 2012-137021 | A | 7/2012 |
| JP | 6099714 | B2 | 3/2017 |

* cited by examiner

EXHAUST CONDUIT ASSEMBLY

CROSS-REFERENCE TO RELATED APPLICATION

This is a bypass continuation of PCT Application No. PCT/US2023/025152, filed Jun. 13, 2023, which claims the benefit of and priority to U.S. Provisional Application No. 63/353,247, filed Jun. 17, 2022. The contents of these applications are incorporated herein by reference in their entirety.

TECHNICAL FIELD

The present disclosure relates generally to doser mounts for exhaust aftertreatment systems of an internal combustion engine.

BACKGROUND

For an internal combustion engine system, it may be desirable to reduce emissions of certain components in exhaust produced by a combustion of fuel. One approach that can be implemented to reduce emissions is to treat the exhaust using an aftertreatment system. It is often desirable to mix exhaust with a reductant used to treat the exhaust. However, heat from the exhaust system may be transferred to the reductant dosing module, which may damage the dosing module.

SUMMARY

In one embodiment, an exhaust conduit assembly includes an exhaust conduit body, an injection aperture, and a doser mount portion. The exhaust conduit defines an exhaust flow path. The injection aperture extends through the exhaust conduit body. The doser mount portion includes an inlet port, a channel, and an outlet port. The inlet port is configured to receive a coolant. The channel is configured to receive the coolant from the inlet port. At least a portion of the channel extends around at least a portion of the injection aperture. The outlet port is configured to receive the coolant from the channel.

In another embodiment, an exhaust aftertreatment system includes an exhaust conduit body defining an exhaust flow path, the exhaust conduit body comprising an inlet and an outlet. The exhaust aftertreatment system includes a support wall extending radially away from the exhaust conduit body. The exhaust aftertreatment system includes an outer wall extending around a portion of the exhaust conduit body. The outer wall is separated from the exhaust conduit body by the support wall. The exhaust aftertreatment system includes an injection aperture extending through the exhaust conduit body. The exhaust aftertreatment system includes a doser mount portion defining a cavity that extends around the injection aperture. The cavity receives a portion of a doser. The exhaust conduit body, the support wall, and the outer wall define at least one air gap. The at least one air gap is disposed between the doser mount portion and at least one of the inlet or the outlet of the exhaust conduit body.

BRIEF DESCRIPTION OF THE DRAWINGS

The disclosure will become more fully understood from the following detailed description, taken in conjunction with the accompanying Figures, wherein like reference numerals refer to like elements unless otherwise indicated, in which.

Figure 1:
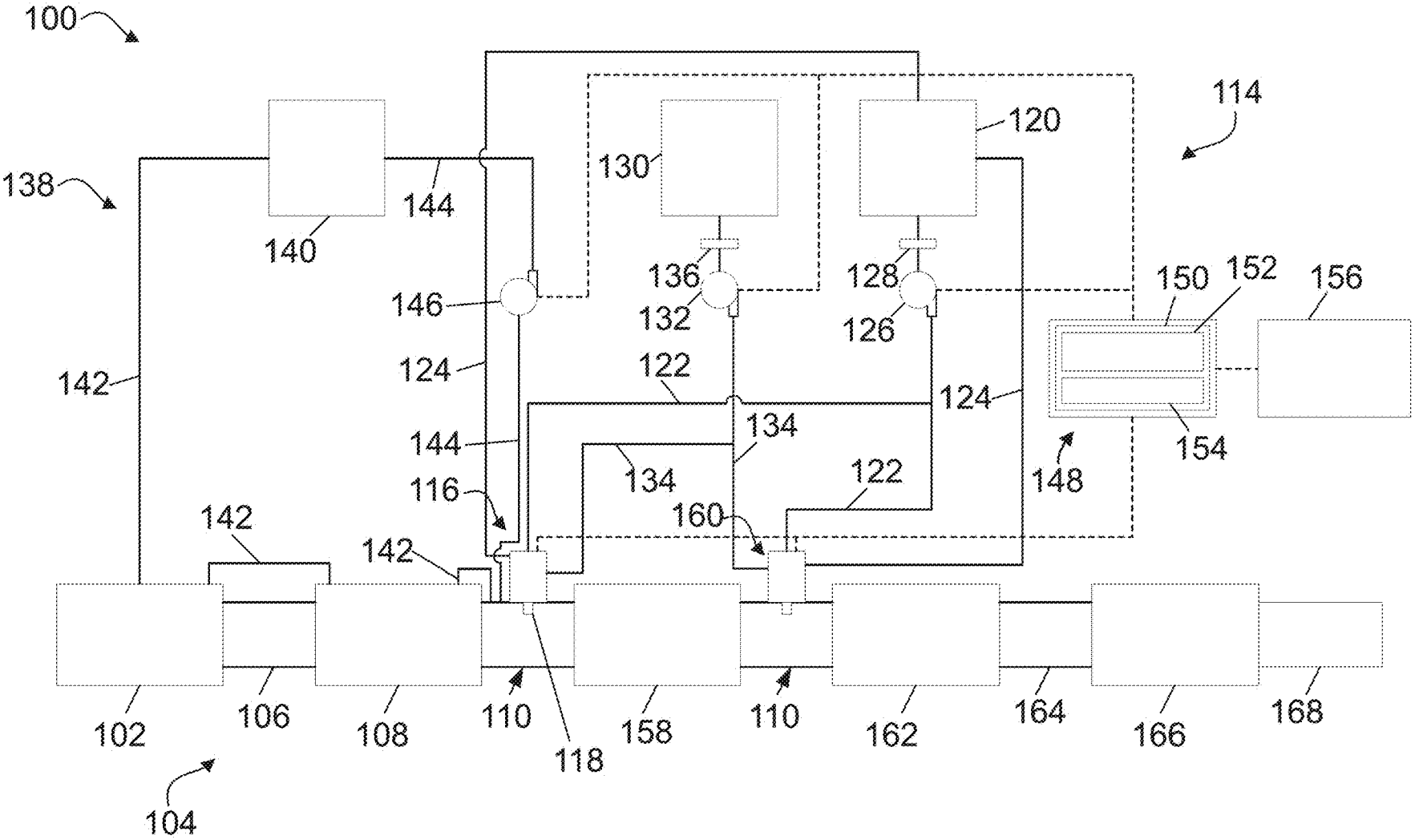
FIG. 1 is a schematic diagram of an example exhaust aftertreatment system including an exhaust conduit assembly.

It will be recognized that the Figures are schematic representations for purposes of illustration. The Figures are provided for the purpose of illustrating one or more implementations with the explicit understanding that the Figures will not be used to limit the scope or the meaning of the claims.

DETAILED DESCRIPTION

Following below are more detailed descriptions of various concepts related to, and implementations of, methods, apparatuses, and for providing an exhaust conduit assembly for an exhaust aftertreatment system of an internal combustion engine. The various concepts introduced above and discussed in greater detail below may be implemented in any of a number of ways, as the described concepts are not limited to any particular manner of implementation. Examples of specific implementations and applications are provided primarily for illustrative purposes.

I. Overview

In order to reduce emissions and optimize performance of an internal combustion engine, it may be desirable to decrease a temperature of a dosing module (e.g., a doser) of an exhaust aftertreatment system. For example, it may be desirable to reduce heat transferred from an internal combustion engine system, for example, via a turbocharger, an exhaust conduit, and exhaust flowing therethrough, to the dosing module.

Implementations herein are related to an exhaust aftertreatment system that provides cooling to a dosing module such that the dosing module can operate desirably in high temperature environments. For example, when an internal combustion engine starts running, coolant can flow through an exhaust conduit assembly to remove heat from a doser mount, and therefore cool a dosing module disposed in the doser mount. The implementations disclosed herein cool an exhaust conduit assembly via a coolant to reduce an amount of heat transferred to the dosing module. Providing coolant to the exhaust conduit assembly allows for a dosing module to be disposed closer to a heat source within the system than would not be possible without such cooling. For example, because a coolant supplied to the exhaust conduit assembly reduces the heat transferred to the dosing module, the dosing module can be disposed proximate to an internal combustion engine, a turbocharger, or other components of an internal combustion engine system that generate heat. The coolant reduces the heat transferred to the dosing module and protects the dosing module from damage that could occur due to high temperatures. The ability for a dosing module to be positioned close to the internal combustion engine and/or turbocharger of a system allows for the system to incorporate more dosing modules which can improve the efficiency and effectiveness of the exhaust aftertreatment system. For example, being able to position the dosing module closer to the heat source allows for the system to incorporate more dosing modules such that more reductant can be introduced into the exhaust to more fully treat the exhaust. The implementations disclosed herein may enhance desirable operation of a system employing one of the coolant-cooled doser mounts described herein.

The implementations disclosed herein can be used with DEF cooled or air-cooled dosing modules, which facilitates use of cheaper dosing technologies. Coolant cooling offers the advantage of locating the dosing module in hot exhaust temperature areas to take advantage of heat to decompose DEF. Furthermore, coolant cooling allows for adding a pressure sensor in the dosing module which can improve dosing accuracy and performance.

II. Overview of Exhaust Aftertreatment Systems

Figure 2:
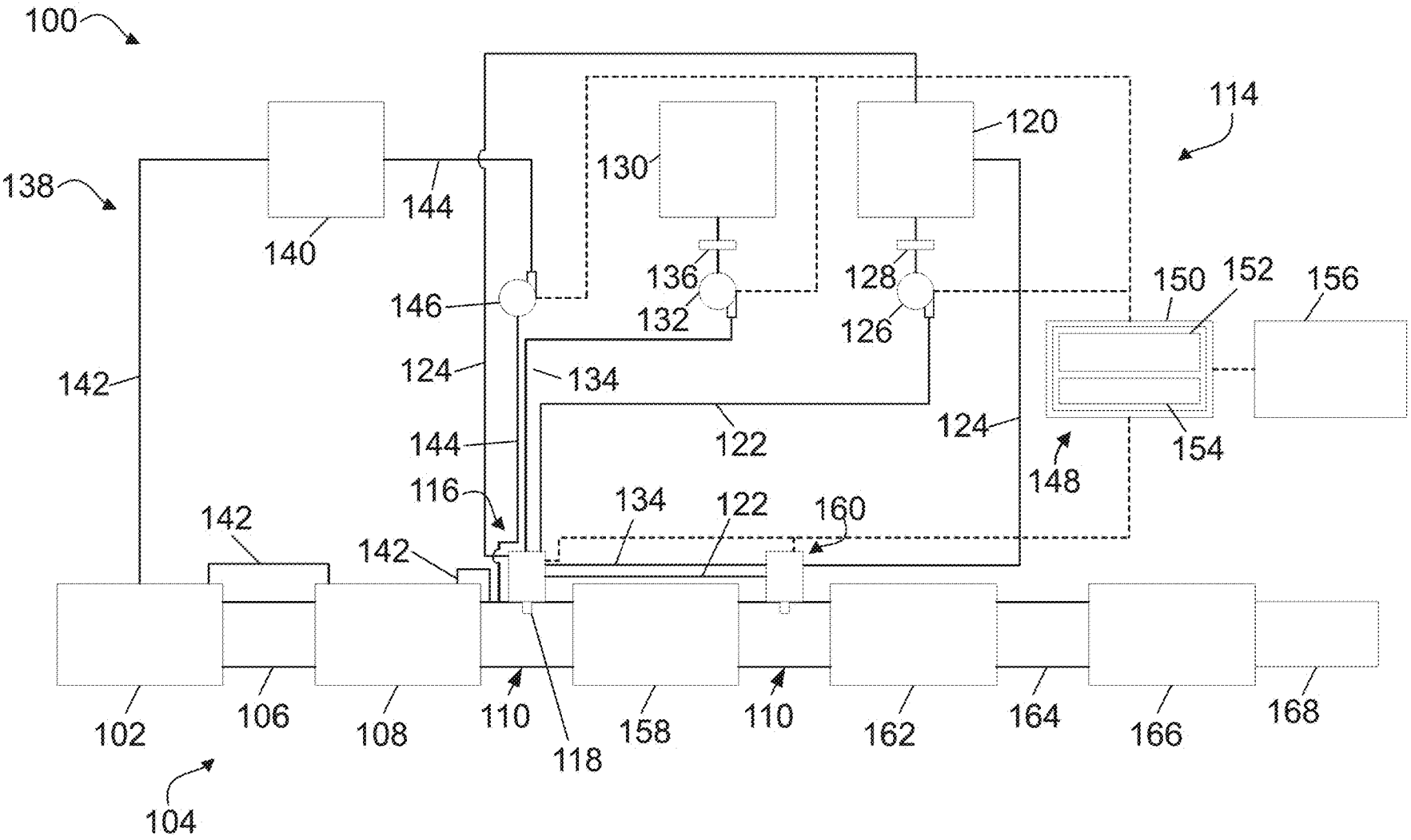
FIG. 2 is a schematic diagram of another example exhaust aftertreatment system including an exhaust conduit assembly.
Figure 3:
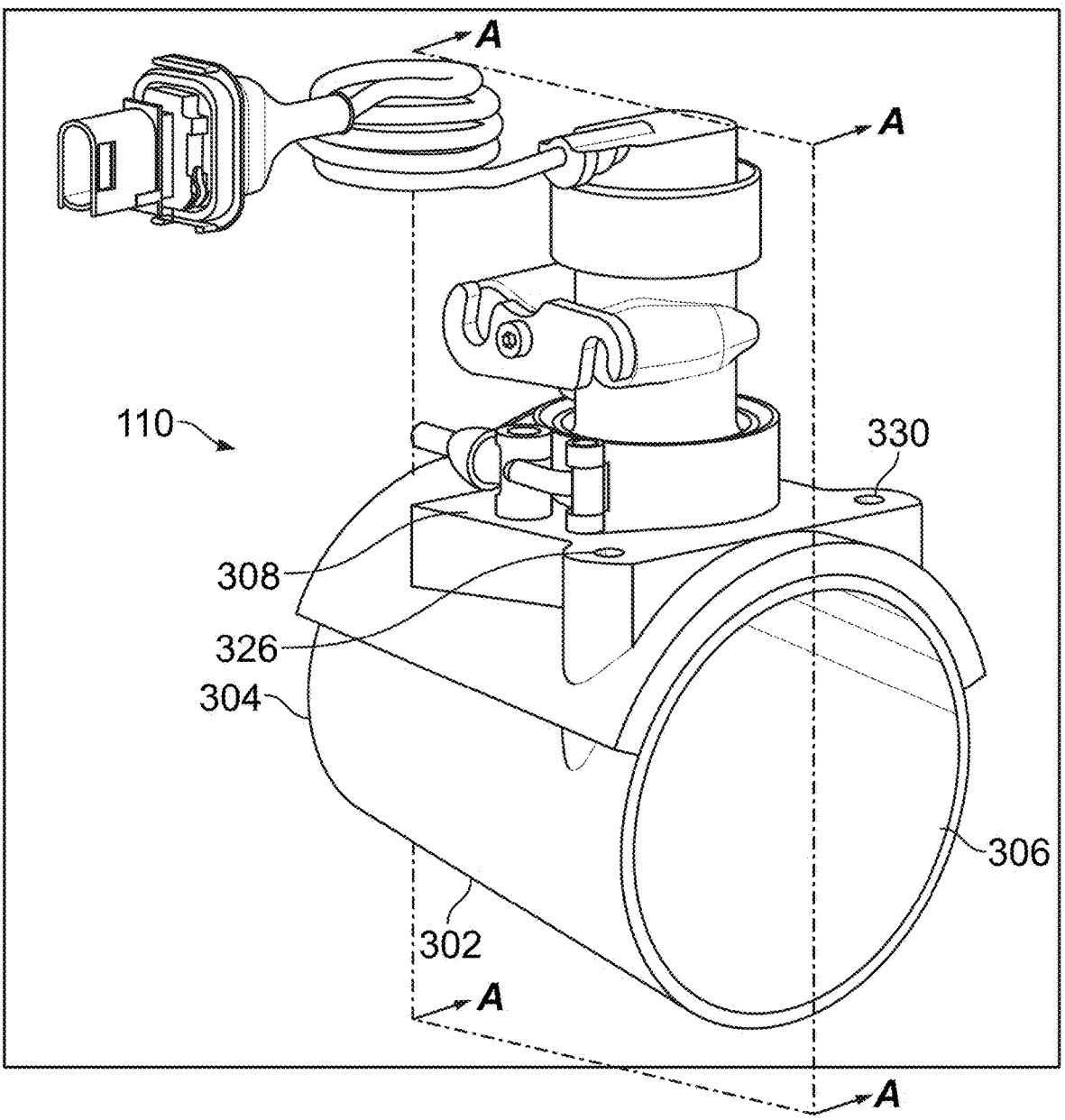
FIG. 3 is a perspective view of an example exhaust conduit assembly for an exhaust aftertreatment system.
Figure 4:
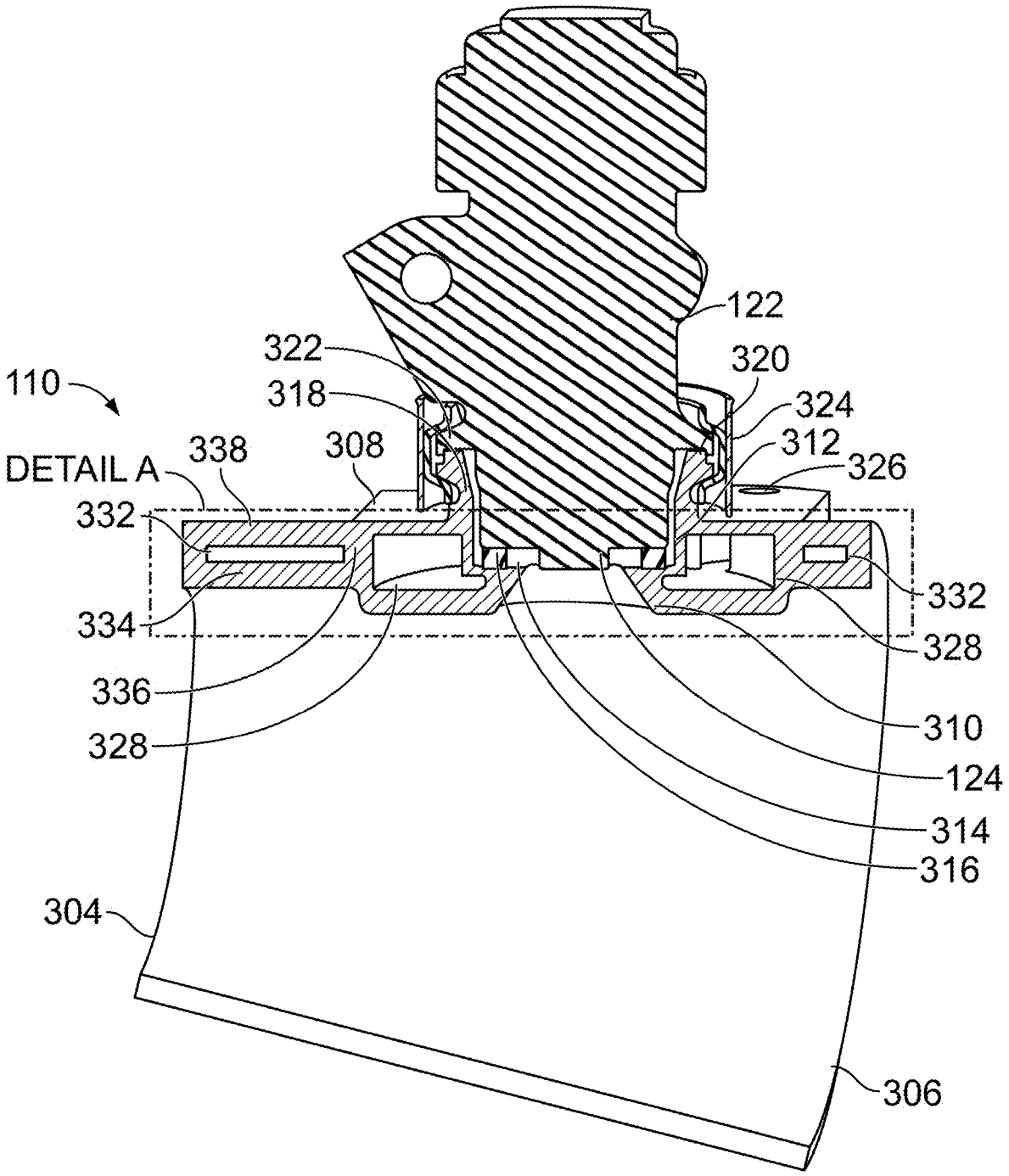
FIG. 4 is a cross-sectional view of the exhaust conduit assembly shown in FIG. 3 taken along plane A-A in FIG. 3.

FIGS. 1 and 2 depict an exhaust aftertreatment system 100 (e.g., treatment system, etc.) for treating exhaust produced by an internal combustion engine 102 (e.g., diesel internal combustion engine, gasoline internal combustion engine, hybrid internal combustion engine, propane internal combustion engine, dual-fuel internal combustion engine, etc.) according to various embodiments. The exhaust aftertreatment system 100 includes an exhaust conduit system 104. The exhaust conduit system 104 is configured to (e.g., structured to, able to, etc.) receive exhaust from the internal combustion engine 102 and provide the exhaust to atmosphere.

The exhaust conduit system 104 includes an upstream exhaust conduit 106 (e.g., line, pipe, etc.). The upstream exhaust conduit 106 is configured to receive exhaust from an upstream component (e.g., header, exhaust manifold, turbocharger, diesel oxidation catalyst, the internal combustion engine 102, etc.). In some embodiments, the upstream exhaust conduit 106 is coupled to (e.g., attached to, fixed to, welded to, fastened to, riveted to, etc.) the internal combustion engine 102 (e.g., the upstream exhaust conduit 106 is coupled to an outlet of the internal combustion engine 102, etc.). In other embodiments, the upstream exhaust conduit 106 is integrally formed with the internal combustion engine 102. As utilized herein, two or more elements are "integrally formed" when the two or more elements are formed and joined together as part of a single manufacturing step to create a single-piece or unitary construction that cannot be disassembled without an at least partial destruction of the single-piece or unitary construction.

The exhaust aftertreatment system 100 also includes a turbocharger 108. The turbocharger 108 is configured to receive exhaust from the internal combustion engine 102. While not shown, the turbocharger 108 also receives air and provides the air to the internal combustion engine 102. The turbocharger 108 utilizes energy from the exhaust produced by the internal combustion engine 102 to provide energy to air provided to the internal combustion engine 102. Specifically, the turbocharger 108 may pressurize the air provided to the internal combustion engine 102. In some embodiments, the turbocharger 108 includes a compressor wheel coupled to a turbine wheel via a connector shaft, where the exhaust produced by the internal combustion engine 102 spins the turbine wheel, which rotates the shaft and the compressor wheel to compress air provided to the internal combustion engine 102. By compressing the air, the turbocharger 108 may enable the internal combustion engine 102 to operate with increased power and/or efficiency.

The exhaust conduit system 104 includes an exhaust conduit assembly 110. The exhaust conduit assembly 110 defines an exhaust flow path. As shown in FIGS. 1 and 2, the exhaust conduit assembly 110 is coupled to the turbocharger 108. For example, the exhaust conduit assembly 110 may be fastened (e.g., using a band, using bolts, etc.), welded, riveted, or otherwise attached to the turbocharger 108. In other embodiments, the exhaust conduit assembly 110 is integrally formed with a housing of the turbocharger 108. In some embodiments, the exhaust conduit assembly 110 is disposed upstream of the turbocharger 108 (e.g., the exhaust conduit assembly 110 provides exhaust to the turbocharger 108, etc.). For example, the exhaust conduit assembly may be disposed between the internal combustion engine 102 and the turbocharger 108. In some embodiments, the exhaust conduit assembly 110 is disposed downstream of the turbocharger 108. For example, the exhaust may be provided from the turbocharger 108 to the exhaust conduit assembly 110 and subsequently to other downstream components of the exhaust aftertreatment system 100. As is explained in more detail herein, the exhaust conduit assembly 110 is configured to facilitate introduction of reductant (e.g., diesel exhaust fluid (DEF), Adblue®, a urea-water solution (UWS), an aqueous urea solution (e.g., AUS32, etc.), into the exhaust so as to facilitate treatment of the exhaust by the subsequent downstream components of the exhaust aftertreatment system 100. The exhaust conduit assembly 110 is also configured to facilitate cooling of a device (e.g., upstream dosing module 116, downstream dosing module 160, described in more detail herein), that is configured to inject the reductant into the exhaust.

The exhaust aftertreatment system 100 also includes a reductant delivery system 114. As is explained in more detail herein, the reductant delivery system 114 is configured to facilitate the introduction of a reductant (e.g., a reductant, a reductant air mixture, etc.) into the exhaust. The reductant delivery system 114 includes an upstream dosing module 116 (e.g., doser, dosing assembly, etc.). The upstream dosing module 116 is configured to facilitate passage of the reductant into the exhaust conduit assembly 110. As is explained in more detail herein, the upstream dosing module 116 is configured to receive reductant, and in some embodiments, configured to receive air and reductant, and provide the reductant and/or air-reductant mixture into the exhaust conduit assembly 110 to facilitate treatment of the exhaust. The upstream dosing module 116 may include an insulator interposed between a portion of the upstream dosing module 116 and the portion of the exhaust conduit assembly 110 on which the upstream dosing module 116 is mounted. The upstream dosing module 116 is coupled to the exhaust conduit assembly 110.

The upstream dosing module 116 includes an injector 118 (e.g., insertion device, etc.). The injector 118 is configured to dose (e.g., inject, insert, etc.) the reductant received by the upstream dosing module 116 into the exhaust within the exhaust conduit assembly 110.

The reductant delivery system 114 also includes a reductant source 120 (e.g., reductant tank, etc.). The reductant source 120 is configured to contain reductant. The reductant delivery system 114 also includes a reductant supply line 122. The reductant source 120 is configured to provide the reductant to the upstream dosing module 116 via the reductant supply line 122. The reductant source 120 may include multiple reductant sources 120 (e.g., multiple tanks connected in series or in parallel, etc.). The reductant source 120 may be, for example, a diesel exhaust fluid tank containing Adblue®. The reductant supplied to the upstream dosing module 116 and not injected into the exhaust conduit assembly 110 can be returned to the reductant source 120 via a reductant return line 124. The reductant from the reductant source 120 may be continuously circulated through the reductant supply and return lines 122, 124 to keep the reductant cool and/or to keep the reductant from freezing.

The reductant delivery system 114 also includes a reductant pump 126 (e.g., supply unit, etc.). The reductant pump 126 is configured to receive the reductant from the reductant source 120 and to provide the reductant to the upstream dosing module 116. For example, the reductant pump 126 is configured to provide the reductant to the injector 118. The reductant pump 126 is used to pressurize the reductant from the reductant source 120 for delivery to the upstream dosing module 116. In some embodiments, the reductant pump 126 is pressure controlled. In some embodiments, the reductant pump 126 is coupled to a chassis of a vehicle associated with the exhaust aftertreatment system 100.

In some embodiments, the reductant delivery system 114 also includes a reductant filter 128. The reductant filter 128 is configured to receive the reductant from the reductant source 120 and to provide the reductant to the reductant pump 126. The reductant filter 128 filters the reductant prior to the reductant being provided to internal components of the reductant pump 126. For example, the reductant filter 128 may inhibit or prevent the transmission of solids to the internal components of the reductant pump 126. In this way, the reductant filter 128 may facilitate prolonged desirable operation of the reductant pump 126.

In various embodiments, the reductant delivery system 114 also includes an air source 130 (e.g., air intake, etc.) and an air pump 132. The air pump 132 is configured to receive air from the air source 130. The air pump 132 is configured to provide the air to the upstream dosing module 116 via an air supply line 134. The upstream dosing module 116 is configured to mix the air and the reductant into an air-reductant mixture and to provide the air-reductant mixture to the injector 118 (e.g., for dosing into the exhaust within the exhaust conduit assembly 110, etc.). The injector 118 is configured to receive the air from the air pump 132. The injector 118 is configured to dose the air-reductant mixture into the exhaust within the exhaust conduit assembly 110. In some of these embodiments, the reductant delivery system 114 also includes an air filter 136. The air filter 136 is configured to receive the air from the air source 130 and to provide the air to the air pump 132. The air filter 136 is configured to filter the air prior to the air being provided to the air pump 132. In other embodiments, the reductant delivery system 114 does not include the air pump 132 and/or the reductant delivery system 114 does not include the air source 130. In such embodiments, the upstream dosing module 116 is not configured to mix the reductant with air.

The exhaust aftertreatment system 100 also includes a coolant delivery system 138 (e.g., engine coolant system, etc.). As is explained in more detail herein, the coolant delivery system 138 is configured to facilitate cooling of components of the exhaust aftertreatment system 100. For example, the coolant delivery system 138 may be configured to cool at least one of the internal combustion engine 102, the turbocharger 108, and the upstream dosing module 116, among others. For example, the exhaust conduit assembly 110 can be disposed close to (e.g., adjacent to, coupled to, etc.) the turbocharger 108, such that the upstream dosing module 116 is disposed close to the turbocharger 108. For example, the upstream dosing module 116 may be between 0 and 500 centimeters (cm) from the turbocharger 108.

The turbocharger 108 is heated by exhaust during operation of the exhaust aftertreatment system 100. In order to maximize the energy that can be harvested from the exhaust, it is often desirable to locate the turbocharger 108 as close to the internal combustion engine 102 as possible. Thus, the exhaust received by the turbocharger 108 is relatively hot. The heat from the turbocharger 108 may be transferred to the exhaust conduit assembly 110 and therefore to the upstream dosing module 116 which causes a temperature of the upstream dosing module 116 to increase. Thus, the coolant delivery system 138 is configured to cool the upstream dosing module 116 by providing coolant to the exhaust conduit assembly 110, which receives and surrounds at least a portion of the upstream dosing module 116. Cooling the upstream dosing module 116 enables the upstream dosing module 116 to be disposed in higher temperature environments without being damaged by the higher temperatures.

The coolant delivery system 138 includes a coolant source 140 (e.g., coolant tank). The coolant source 140 can contain any type of fluid capable of capturing heat. The coolant delivery system 138 also includes a coolant supply line 142. As is described in more detail herein, the coolant source 140 is configured to provide the coolant to the exhaust conduit assembly 110 via the coolant supply line 142. The coolant supply line 142 can directly or indirectly fluidly couple the coolant source 140 with exhaust conduit assembly 110. For example, the coolant supply line 142 can provide coolant to the internal combustion engine 102, then from the internal combustion engine 102 to the turbocharger 108, then from the turbocharger 108 to the exhaust conduit assembly 110. In other embodiments, the coolant supply line extends directly from the coolant source 140 to the exhaust conduit assembly 110.

The coolant delivery system 138 also includes coolant return line 144. The coolant return line 144 is configured to return the coolant to the coolant source 140 from the exhaust conduit assembly 110.

The coolant delivery system 138 also includes a coolant pump 146. The coolant pump 146 can be configured to provide the coolant to the exhaust conduit assembly 110, or other components of the exhaust aftertreatment system 100. The coolant pump 146, along with all other pumps disclosed herein (e.g., reductant pump 126, air pump 132), can be disposed on the supply side or return side of their respective systems. For example, the coolant pump 146 can be coupled with the coolant return line 144 or the coolant supply line 142.

The exhaust aftertreatment system 100 also includes a controller 148 (e.g., control circuit, driver, etc.). The controller 148 is configured control components of the reductant delivery system 114. For example, the upstream dosing module 116, the reductant pump 126, the air pump 132, and the coolant pump 146 are electrically or communicatively coupled to the controller 148. The controller 148 is configured to control the upstream dosing module 116 to dose the reductant and/or the air-reductant mixture into the exhaust conduit assembly 110. The controller 148 may also be configured to control the reductant pump 126 and/or the air pump 132 in order to control the reductant and/or the air-reductant mixture that is dosed into the exhaust conduit assembly 110. The controller 148 is also configured to control the coolant pump 146 to control the coolant provided to the exhaust conduit assembly 110.

The controller 148 includes a processing circuit 150. The processing circuit 150 includes a processor 152. The processor 152 may include a microprocessor, an application-specific integrated circuit (ASIC), a field-programmable gate array (FPGA), etc., or combinations thereof. The processing circuit 150 also includes a memory 154. The memory 154 may include, but is not limited to, electronic, optical, magnetic, or any other storage or transmission device capable of providing a processor, ASIC, FPGA, etc. with program instructions. This memory 154 may include a memory chip, Electrically Erasable Programmable Read-Only Memory (EEPROM), Erasable Programmable Read Only Memory (EPROM), flash memory, or any other suitable memory from which the controller 148 can read instructions. The instructions may include code from any suitable programming language. The memory 154 may include various modules that include instructions which are configured to be implemented by the processor 152.

In various embodiments, the controller 148 is configured to communicate with a central controller 156 (e.g., engine control unit (ECU), engine control module (ECM), etc.) of an internal combustion engine having the exhaust aftertreatment system 100. In some embodiments, the central controller 156 and the controller 148 are integrated into a single controller.

In some embodiments, the central controller 156 is communicable with a display device (e.g., screen, monitor, touch screen, heads up display (HUD), indicator light, etc.). The display device may be configured to change state in response to receiving information from the central controller 156. For example, the display device may be configured to change between a static state and an alarm state based on a communication from the central controller 156. By changing state, the display device may provide an indication to a user of a status of the reductant delivery system 114.

In some embodiments, the exhaust aftertreatment system 100 also includes a particulate filter 158 (e.g., a diesel particulate filter (DPF)). The particulate filter 158 is configured to receive exhaust from an upstream exhaust conduit (e.g., exhaust conduit assembly 110). The particulate filter 158 is configured to remove particulate matter, such as soot, from exhaust flowing in the exhaust conduit system 104. The particulate filter 158 includes an inlet, where the exhaust is received, and an outlet, where the exhaust exits after having particulate matter substantially filtered from the exhaust and/or converting the particulate matter into carbon dioxide. In some implementations, the particulate filter 158 may be omitted. In various embodiments, the particulate filter 158 is coupled to the exhaust conduit assembly 110. For example, the particulate filter 158 may be fastened (e.g., using a band, using bolts, etc.), welded, riveted, or otherwise attached to the exhaust conduit assembly 110. In other embodiments, the particulate filter 158 is integrally formed with (e.g., unitarily formed with, formed as a one-piece construction with, inseparable from, etc.) the exhaust conduit assembly 110.

In some embodiments, the exhaust aftertreatment system 100 may include an exhaust conduit assembly 110 that extends from or is coupled to an outlet of the particulate filter 158. For example, an exhaust conduit assembly 110 may be disposed downstream from the particulate filter 158. In some embodiments, the exhaust conduit system 104 includes more than one exhaust conduit assembly 110. For example, a first exhaust conduit assembly 110 may be disposed upstream from the particulate filter 158 and a second exhaust conduit assembly 110 may be disposed downstream from the particulate filter 158.

With the exhaust conduit assembly 110 disposed downstream from the particulate filter 158, the reductant delivery system 114 of the exhaust aftertreatment system 100 may include a downstream dosing module 160. The downstream dosing module 160 may be similar to the upstream dosing module 116. For example, the downstream dosing module 160 receives reductant from the reductant source 120 (or a different reductant source) and may receive air from the air source 130 (or a different air source) to provide a reductant or a reductant mixture to the exhaust. As shown in FIG. 1, both the downstream dosing module 160 and the upstream dosing module 116 have a separate reductant supply line 122 extending from the reductant source 120 (or after the reductant pump 126) and a separate air supply line 134 extending from the air source 130 (or after the air pump 132). In some embodiments, the downstream dosing module 160 or the second exhaust conduit assembly 110 also receives coolant from the coolant source 140 (or a different cooling source). In other embodiments, the downstream dosing module 160 and the second exhaust conduit assembly 110 do not receive coolant. For example, the downstream dosing module 160 may be far enough away from the turbocharger such that heat transfer is not a concern with respect to the downstream dosing module 160. Therefore, the downstream dosing module 160 may not need to be cooled.

The downstream dosing module 160 is also electrically or communicably coupled to the controller 148. The controller 148 is configured to control the downstream dosing module 160 to dose the reductant and/or the air-reductant mixture into the second exhaust conduit assembly 110. The controller 148 may also be configured to control the reductant pump 126 and/or the air pump 132 in order to control the reductant and/or the air-reductant mixture that is dosed into the second exhaust conduit assembly 110.

In various embodiments, the exhaust conduit system 104 of the exhaust aftertreatment system 100 further includes a decomposition chamber 162 (e.g., decomposition reactor, decomposition chamber, reactor pipe, decomposition tube, reactor tube, etc.). The decomposition chamber 162 is configured to receive exhaust from an exhaust conduit assembly 110 and/or another exhaust conduit of the exhaust conduit system 104 (e.g., after the reductant has been provided into the exhaust) and the reductant. For example, the decomposition chamber 162 may be coupled to the exhaust conduit assembly 110. The decomposition chamber 162 may be fastened, welded, riveted, or otherwise attached to the exhaust conduit assembly 110. In other embodiments, the decomposition chamber 162 is integrally formed with the exhaust conduit assembly 110.

The decomposition chamber 162 is configured to convert the reductant into ammonia. The reductant may be, for example, urea, diesel exhaust fluid (DEF), Adblue®, a urea water solution (UWS), an aqueous urea solution (e.g., AUS32, etc.), and/or other similar fluids. The decomposition chamber 162 includes an inlet that may be in fluid communication with the exhaust conduit assembly 110 to receive the exhaust containing NOx emissions and an outlet for the exhaust, NOx emissions, ammonia, and/or reductant to flow to a downstream component.

In various embodiments, the exhaust conduit system 104 includes a midstream exhaust conduit 164. The midstream exhaust conduit 164 is disposed downstream from the upstream exhaust conduit 106. The exhaust conduit system 104 may include more than one midstream exhaust conduit 164. The midstream exhaust conduit 164 may be configured to couple the decomposition chamber 162 to another component of the exhaust conduit system 104 that is downstream from the decomposition chamber. The midstream exhaust conduit 164 defines an exhaust flow path such that exhaust can flow from the decomposition chamber 162 to the downstream component. A midstream exhaust conduit 164 can be used to couple any components of the exhaust conduit system 104 together to provide a path for exhaust to flow between the components and through the exhaust conduit system. For example, if the exhaust aftertreatment system 100 does not include a downstream dosing module 160, a midstream exhaust conduit 164 may couple the particulate filter 158 to the decomposition chamber 162 rather than an exhaust conduit assembly 110.

In some embodiments, instead of a midstream exhaust conduit 164 coupling the decomposition chamber 162 to a downstream component, the exhaust conduit system 104 includes another exhaust conduit assembly 110 to couple the decomposition chamber 162 to the downstream component. For example, the exhaust aftertreatment system 100 may include another downstream dosing module 160 to be disposed between the decomposition chamber 162 and the downstream component. In such embodiments, an exhaust conduit assembly 110 may couple the decomposition chamber 162 to the downstream component and the downstream dosing module 160 can couple to the exhaust conduit assembly 110.

In various embodiments, the exhaust conduit system 104 of the exhaust aftertreatment system 100 includes a SCR catalyst member 166. The SCR catalyst member 166 is located downstream of the decomposition chamber 162 and configured to receive a mixture of the reductant and exhaust. The reductant droplets undergo the processes of evaporation, thermolysis, and hydrolysis to form non-NOx emissions (e.g., gaseous ammonia, etc.) within the exhaust conduit system 104.

The SCR catalyst member 166 includes an inlet in fluid communication with the decomposition chamber 162 from which exhaust and reductant are received and an outlet in fluid communication with a downstream component or an end of the exhaust conduit system 104. In various embodiments, the SCR catalyst member 166 is coupled to the decomposition chamber 162. For example, the SCR catalyst member 166 may be fastened, welded, riveted, or otherwise attached to the decomposition chamber 162. In other embodiments, the SCR catalyst member 166 is integrally formed with the decomposition chamber 162. The SCR catalyst member 166 is located downstream of the decomposition chamber 162 and receives the exhaust from the decomposition chamber 162. In some embodiments, and the SCR catalyst member 166 is fluidly coupled with the decomposition chamber 162 via an exhaust conduit assembly 110 or some other exhaust conduit of the exhaust conduit system 104 (e.g., midstream exhaust conduit 164, described in more detail herein).

The SCR catalyst member 166 is configured to receive, treat, and output an exhaust output. For example, the SCR catalyst member 166 is configured to cause decomposition of components of the exhaust using the reductant (e.g., via catalytic reactions, etc.). Specifically, reductant that has been provided into the exhaust in the exhaust conduit assembly 110 undergoes the processes of evaporation, thermolysis, and hydrolysis to form non-NOx emissions within the decomposition chamber 162 and the SCR catalyst member 166. The SCR catalyst member 166 is configured to assist in the reduction of NOx emissions by accelerating a NOx reduction process between the reductant and the NOx of the exhaust into diatomic nitrogen, water, and/or carbon dioxide.

The exhaust aftertreatment system 100 also includes a downstream exhaust conduit 168 (e.g., line, pipe, etc.). The downstream exhaust conduit 168 is downstream from the midstream exhaust conduit 164. The downstream exhaust conduit 168 is downstream of the SCR catalyst member 166 and is configured to receive the exhaust from the SCR catalyst member 166. In some embodiments, the downstream exhaust conduit 168 is coupled to the SCR catalyst member 166. In other embodiments, the downstream exhaust conduit 168 is integrally formed with the SCR catalyst member 166.

FIG. 2 illustrates another embodiment of the exhaust aftertreatment system 100. In such embodiment, both the upstream dosing module 116 and the downstream dosing module 160 receive reductant from the reductant source 120. The reductant pump 126 initially provides the reductant to the upstream dosing module 116 via the reductant supply line 122, then the reductant supply line 122 extends from the upstream dosing module 116 to the downstream dosing module 160 such that the reductant travels from the upstream dosing module 116 to the downstream dosing module 160. The reductant return line 124 receives the reductant from the downstream dosing module 160 and returns the reductant to the reductant source 120.

Both the upstream dosing module 116 and the downstream dosing module 160 receive air from the air source 130. The air pump 132 initially provides the air to the upstream dosing module 116 via the air supply line 134, then the air supply line 134 extends from the upstream dosing module 116 to the downstream dosing module 160 such that the air travels from the upstream dosing module 116 to the downstream dosing module 160. The air may be released from the downstream dosing module 160 or the reductant delivery system 114 may include an air return line to return the air to the air source 130.

In some embodiments, a first exhaust conduit assembly 110 and a second exhaust conduit assembly 110 receive coolant from the coolant source 140. Similar to the reductant and air, the coolant can be provided to each exhaust conduit assembly 110 separately, or the coolant can be provided to the first exhaust conduit assembly 110 and then transferred from the first exhaust conduit assembly 110 to the second exhaust conduit assembly 110.

While the exhaust aftertreatment system 100 has been shown and described in the context of use with a diesel internal combustion engine, it is understood that the exhaust aftertreatment system 100 may be used with other internal combustion engines, such as gasoline internal combustion engines, hybrid internal combustion engines, propane internal combustion engines, dual-fuel internal combustion engines, and other similar internal combustion engines.

While the reductant delivery system 114 has been shown and described in the context of use with a reductant, it is understood that the reductant delivery system 114 may be used instead with a hydrocarbon fluid (e.g., fuel, lubricant, oil, etc.). In these embodiments, an igniter (e.g., spark plug, etc.) may be positioned downstream of the upstream dosing module 116 and utilized to ignite the hydrocarbon fluid. This ignition causes an increase in temperature of the exhaust downstream of the upstream dosing module 116, which may be utilized to regenerate the SCR catalyst member 166.

III. Example Exhaust Conduit Assemblies

FIGS. 3-9 illustrate the exhaust conduit assembly 110 according to various embodiments. The exhaust conduit assembly 110 includes an exhaust conduit body 302. The exhaust conduit body 302 defines an exhaust flow path. For example, the exhaust conduit body 302 includes an inlet 304 and an outlet 306. The inlet 304 can be configured to receive exhaust from an upstream component (e.g., the turbocharger 108) and a downstream component (e.g., the particulate filter 158) can be configured to receive the exhaust from the outlet 306 such that the exhaust flows from the inlet 304 through the exhaust conduit body 302 to the outlet 306. In some embodiments, the area of the inlet 304 is the same as the area of the outlet 306 (e.g., the exhaust conduit body 302 has a constant cross-sectional area from the inlet 304 to the outlet 306). In some embodiments, the area of the inlet 304 is different than the area of the outlet 306. For example, the area of the inlet 304 may be smaller than the area of the outlet 306. The area of the inlet 304 may also be larger than the area of the outlet 306. The exhaust conduit body 302 may be made of 316L or 439L stainless steel, for example.

Figure 7:
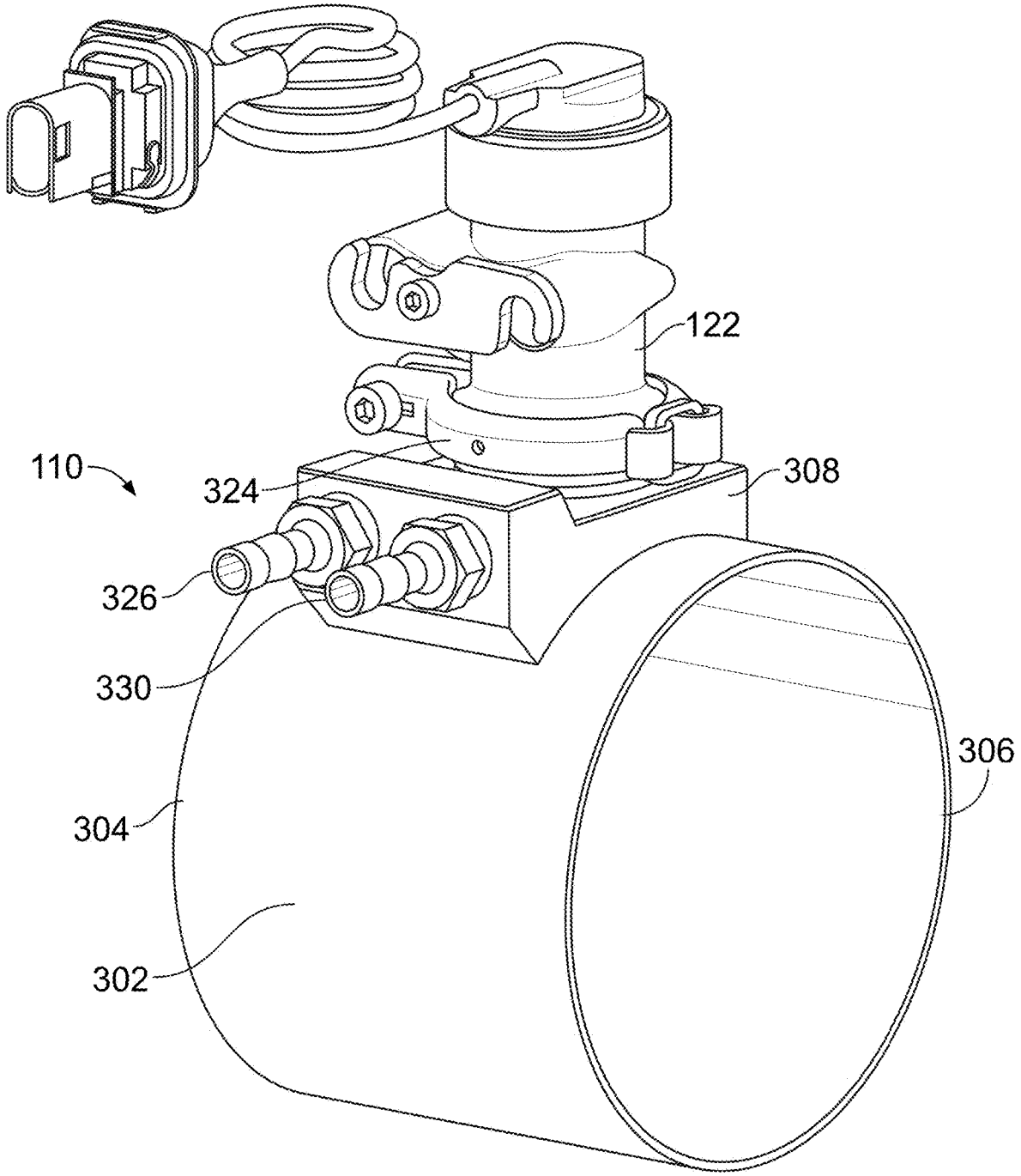
FIG. 7 is a perspective view of another example exhaust conduit assembly for an exhaust aftertreatment system.
Figure 8:
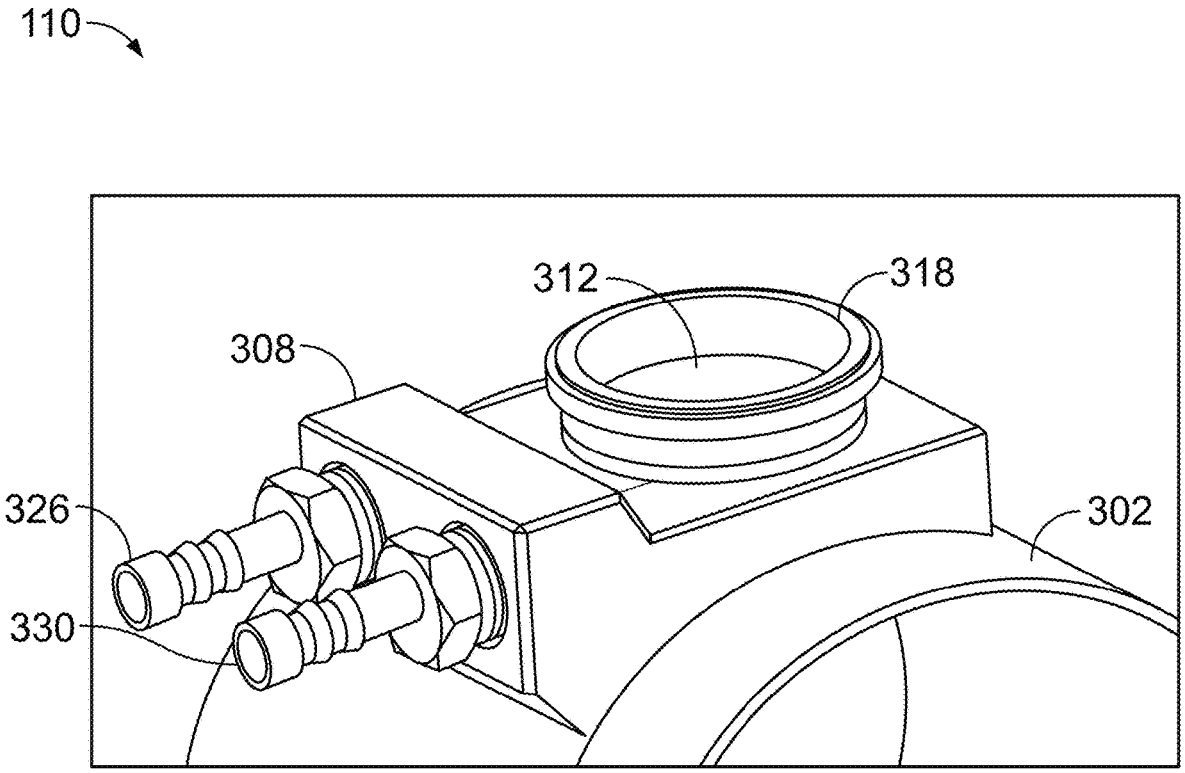
FIG. 8 is a perspective view of a portion of the exhaust conduit assembly shown in FIG. 7.
Figure 9:
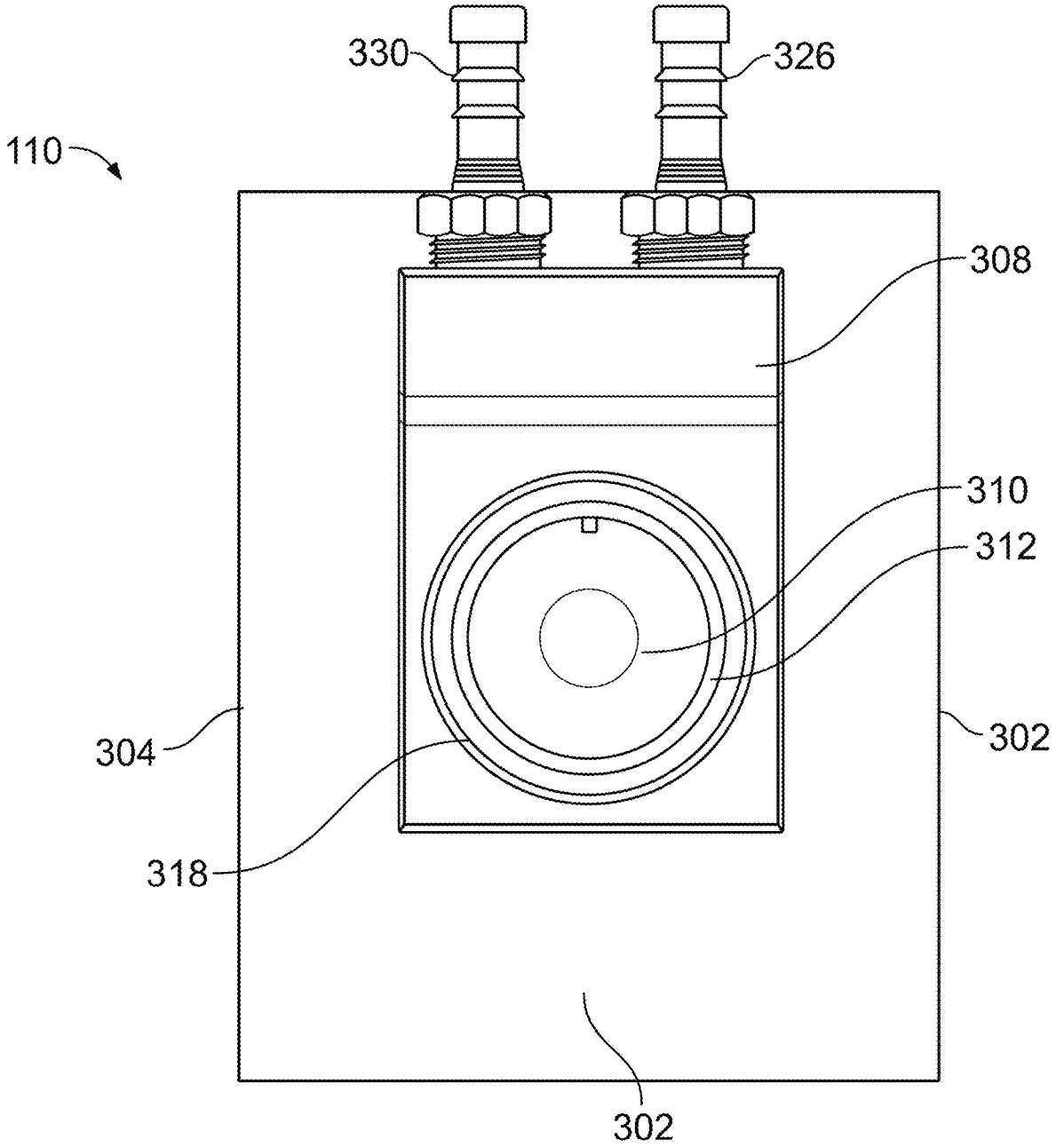
FIG. 9 is a top view of the portion of the exhaust conduit assembly shown in FIG. 8.

In some embodiments, the exhaust conduit assembly 110 also includes a doser mount portion 308. The doser mount portion 308 may be coupled to the exhaust conduit body 302. For example, as shown in FIGS. 7-9, the doser mount portion 308 may be fastened (e.g., using a band, using bolts, etc.), welded, riveted, or otherwise attached to the exhaust conduit body 302. In some embodiments, the doser mount portion 308 is integrally formed with the exhaust conduit body 302. For example, as shown in FIGS. 3-6, the doser mount portion 308 and the exhaust conduit body 302 form a single component. The doser mount portion 308 facilitates injection of a reductant into the exhaust conduit body 302 for treatment of an exhaust. For example, the exhaust conduit assembly 110 includes an injection aperture 310. The injection aperture 310 extends through the exhaust conduit body 302. The injection aperture 310 provides a path for reductant to enter the exhaust conduit body 302. The injection aperture 310 may have a conical shape. For example, an inlet of the injection aperture 310 may have a smaller area than an outlet of the injection aperture 310.

The doser mount portion 308 is configured to couple to upstream dosing module 116 such that an injector 118 of the upstream dosing module 116 is configured to provide a reductant through the injection aperture 310 and into the exhaust conduit body 302. In some embodiments, the doser mount portion 308 defines a cavity 312 that extends around the injection aperture 310. The doser mount portion 308 is configured to receive a portion of the upstream dosing module 116 within the cavity 312. The doser mount portion 308 has a ridge 314 configured to interface, either directly or indirectly, with the upstream dosing module 116. For example, a face of the upstream dosing module 116 may rest on or interface with the ridge 314 when the upstream dosing module 116 is received within the cavity 312. The ridge 314 can define a base or bottom of the cavity 312. The ridge 314 can define an inlet of the injection aperture 310. In some embodiments, an insulator 316 can be disposed between the face of the upstream dosing module 116 and the ridge 314. The insulator 316 facilitates further reduction of heat transfer from the exhaust to the upstream dosing module 116.

While the doser mount portion 308 and the exhaust conduit assembly 110 are generally described as interacting with and coupling to an upstream dosing module 116, the embodiments described herein may interact with and/or couple to other dosing modules, including but not limited to the downstream dosing module 160. The exhaust aftertreatment system 100 may include any number of dosing modules that are configured to couple with the exhaust conduit system 104 via an exhaust conduit assembly 110.

The doser mount portion 308 includes a mount 318. The mount 318 extends from the doser mount portion 308. The mount 318 is coupled to or integral with the doser mount portion 308 at a center of the doser mount portion 308. For example, the mount 318 may be welded to the doser mount portion 308. The mount 318 may be made of 316L or 439L stainless steel, for example. The mount 318 is located centrally such that a channel 328, described in more detail below, can surround at least a portion of a dosing module received by the mount 318. The mount 318 defines a portion of the cavity 312. The mount 318 is configured to interface with the upstream dosing module 116. For example, the mount 318 includes a rim 320. The upstream dosing module 116 may have a corresponding flange 322. The rim 320 of the mount 318 may interface with the flange 322 of the upstream dosing module 116. The exhaust aftertreatment system 100 may include an external component 324 (e.g., a clamp) configured to fix, at least temporarily, the flange 322 and the rim 320 together to couple the upstream dosing module 116 with the doser mount portion 308.

The doser mount portion 308 includes an inlet port 326 configured to receive a coolant. The inlet port 326 may receive the coolant from the coolant source 140, or from other components of the exhaust aftertreatment system 100. For example, the exhaust aftertreatment system 100 may include a turbocharger 108. The turbocharger 108 may be configured to receive a coolant and exhaust. The turbocharger 108 and the exhaust conduit system 104 may be configured such that the exhaust conduit body 302 receives the exhaust from the turbocharger 108 and the inlet port 326 of the doser mount portion 308 receives the coolant from the turbocharger 108. In some embodiments, the inlet port 326 is connected to the internal combustion engine 102. For example, the internal combustion engine 102 may receive the coolant first from the coolant source 140 and then the coolant can transfer from the internal combustion engine 102 to the upstream dosing module 116 via a coolant supply line 142. The exhaust aftertreatment system 100 may be configured such that responsive to the internal combustion engine 102 activating, the coolant flows to the doser mount portion 308 to remove heat from the doser mount portion 308 to cool the upstream dosing module 116.

The doser mount portion 308 includes a channel 328. The channel 328 is configured to receive the coolant from the inlet port 326. At least a portion of the channel 328 extends around at least a portion of the injection aperture 310. In some embodiments, the channel 328 extends around an entirety of the injection aperture 310. A portion of the channel 328 may be disposed adjacent to the cavity 312 of the doser mount portion 308. A portion of the channel 328 may be disposed adjacent to the injection aperture 310. A portion of the channel 328 may be disposed adjacent to the ridge 314 (e.g., below the cavity 312). The channel 328 may surround at least a portion of the injection aperture 310 and the cavity 312 to surround the areas that have high heat potential.

Figure 5:
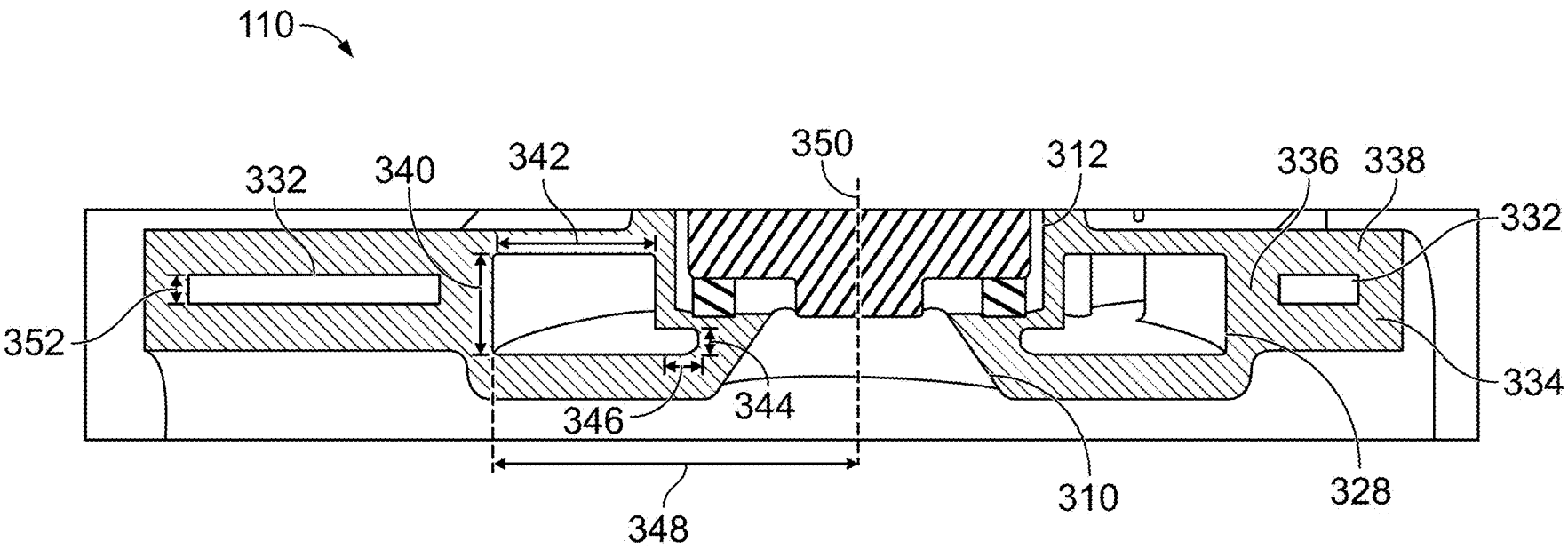
FIG. 5 is a detailed view of DETAIL A shown in FIG. 4.
Figure 6:
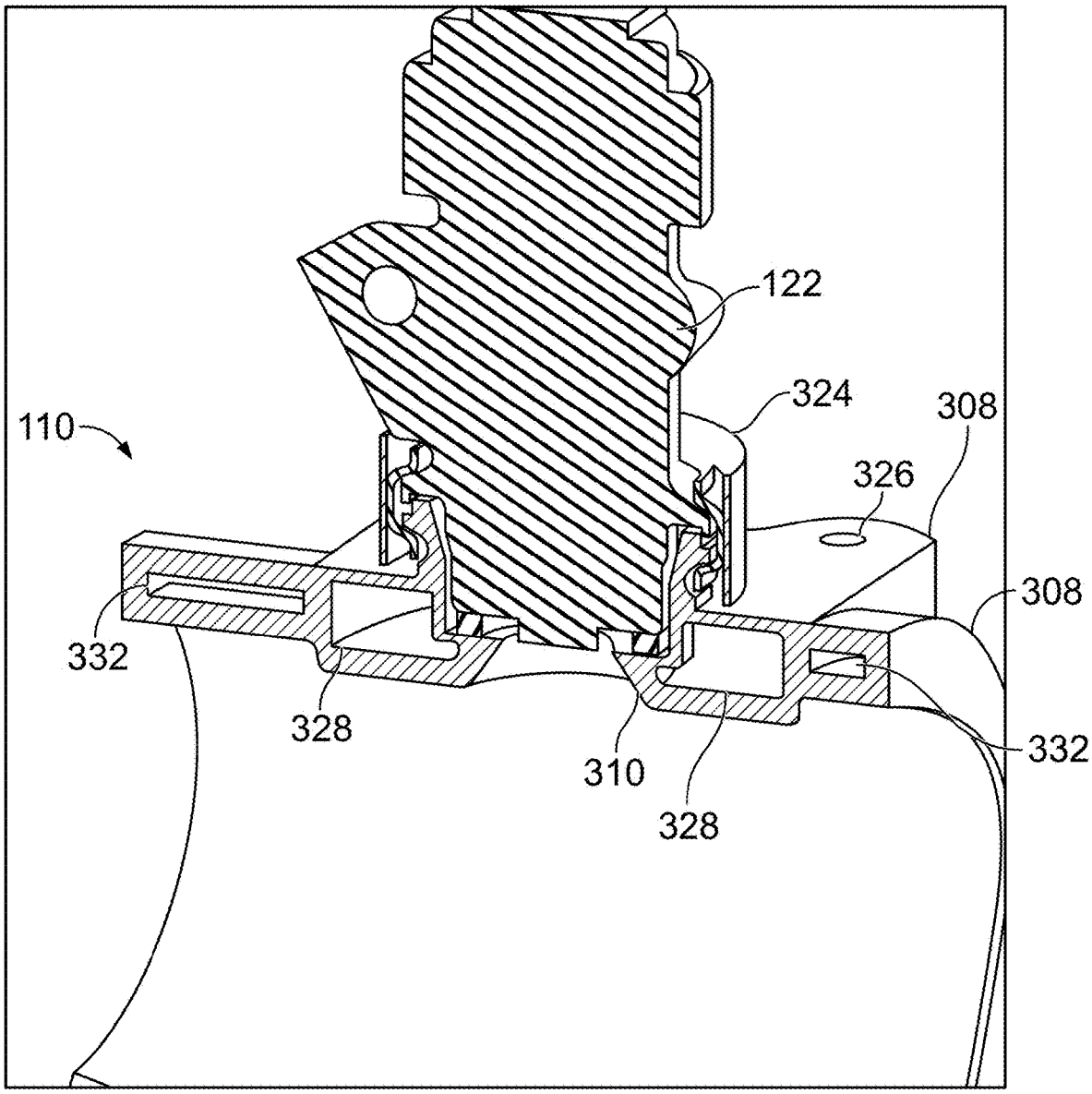
FIG. 6 is a perspective cross-sectional view of the exhaust conduit assembly shown in FIG. 3 taken along plane A-A in FIG. 3.

The channel 328 is configured to provide a path for coolant to flow around the upstream dosing module 116 to reduce the amount of heat transferred from the internal combustion engine 102, turbocharger 108, exhaust from within the exhaust conduit body 302, etc., to the upstream dosing module 116. The channel 328 may have a constant cross-sectional area as it extends around the injection aperture 310. For example, as shown in FIG. 5, a first portion of the channel 328 may have a first height 340 and a first width 342. A second portion of the channel 328 may have a second height 344 and a second width 346. The first height 340 may be, for example, at least 9.5 mm (e.g., 9.518180 mm). The first height 340 may range from 9 mm to 10 mm. The first width 342 may be, for example, at least 15.3 mm (e.g., 15.394981 mm). The first width 342 may range from 14.5 mm to 16.5 mm. The second height 344 may be shorter than the first height 340 and the second width 346 may be shorter than the first width 342. The first portion of the channel 328 may be disposed adjacent to both the cavity 312 and the injection aperture and the second portion of the channel 328 may be disposed adjacent to the injection aperture 310. Part of the second portion of the channel 328 may be disposed under the cavity 312.

The channel 328 may be configured to wrap around at least a portion of the injection aperture 310. For example, the channel 328 may have an outer diameter 348 of at least 68.7 mm (e.g., 68.7928 mm), or a radius of at least 34.395 mm (e.g., 34.396400 mm). The outer diameter 348 may range from 65 mm-70 mm. The outer diameter 348 is measured from a central axis 350 of the injection aperture 310 to an outer wall of the channel 328.

The doser mount portion 308 also includes an outlet port 330. The outlet port 330 is configured to receive the coolant from the channel 328. The channel 328 fluidly couples the inlet port 326 to the outlet port 330. The coolant can flow out of the channel 328 via the outlet port 330 and to another component of the exhaust aftertreatment system 100. For example, the outlet port 330 may be fluidly coupled to an inlet of the coolant pump 146. The coolant pump 146 may be configured to receive the coolant. In some embodiments, the inlet port 326 and the outlet port 330 can be disposed on a top face of the doser mount portion 308. In other embodiments, the inlet port 326 and/or the outlet port 330 extend from a side of the doser mount portion 308.

In some embodiments, the exhaust conduit assembly 110 includes an air gap 332. The air gap 332 can be disposed adjacent to a portion of the channel 328. The air gap 332 is configured to provide additional thermal control and insulation to the upstream dosing module 116. For example, the air gap 332 reduces a direct contact path for the heat to travel to the mount 318. The air gap 332 is defined, at least partially, by an inner wall 334. The inner wall may be the exhaust conduit body 302. The air gap 332 is further defined, at least partially, by a support wall 336. The support wall 336 is coupled to or integrally formed with the inner wall 334 and extends radially away from the inner wall 334. The support wall 336 separates the air gap 332 from the channel 328. The air gap 332 is further defined, at least partially, by an outer wall 338. The outer wall 338 is coupled to or integrally formed with the support wall 336. The outer wall 338 is separated from the inner wall 334 by the support wall 336 such that the air gap 332 extends between the outer wall 338 and the inner wall 334. For example, a distance between the inner wall 334 and the outer wall 338 may be 3 mm, such that a height 352 of the air gap 332 is 3 mm. The air gap height 352 may range from 2 mm to 5 mm. The outer wall 338 extends around a portion of the inner wall 334. For example, the outer wall 338 may extend around less than half of the inner wall 334.

The exhaust conduit assembly 110 may include a plurality of air gaps 332. For example, a first air gap 332 may be disposed, at least partially, between a first portion of the channel 328 and the inlet 304 of the exhaust conduit body 302. A second air gap 332 may be disposed, at least partially, between a second portion of the channel 328 and the outlet 306 of the exhaust conduit body 302. In some embodiments, a portion of the first and second air gaps 332 are connected to form a larger air gap 332 that extends along a length of the exhaust conduit body 302.

IV. Configuration of Example Embodiments

As utilized herein, an area is measured along a plane (e.g., a two-dimensional plane, etc.) unless otherwise indicated. This area may change in a direction that is not disposed along the plane (e.g., along a direction that is orthogonal to the plane, etc.) unless otherwise indicated.

While this specification contains many specific implementation details, these should not be construed as limitations on the scope of what may be claimed but rather as descriptions of features specific to particular implementations. Certain features described in this specification in the context of separate implementations can also be implemented in combination in a single implementation. Conversely, various features described in the context of a single implementation can also be implemented in multiple implementations separately or in any suitable subcombination. Moreover, although features may be described as acting in certain combinations and even initially claimed as such, one or more features from a claimed combination can, in some cases, be excised from the combination, and the claimed combination may be directed to a subcombination or variation of a subcombination.

As utilized herein, the terms "substantially," "generally," "approximately," and similar terms are intended to have a broad meaning in harmony with the common and accepted usage by those of ordinary skill in the art to which the subject matter of this disclosure pertains. It should be understood by those of skill in the art who review this disclosure that these terms are intended to allow a description of certain features described and claimed without restricting the scope of these features to the precise numerical ranges provided. Accordingly, these terms should be interpreted as indicating that insubstantial or inconsequential modifications or alterations of the subject matter described and claimed are considered to be within the scope of the appended claims.

The term "coupled" and the like, as used herein, mean the joining of two components directly or indirectly to one another. Such joining may be stationary (e.g., permanent) or moveable (e.g., removable or releasable). Such joining may be achieved with the two components or the two components and any additional intermediate components being integrally formed as a single unitary body with one another, with the two components, or with the two components and any additional intermediate components being attached to one another.

The terms "configured to receive exhaust from," "configured to receive air from," "configured to receive reductant from," and the like, as used herein, mean the two components or objects have a pathway formed between the two components or objects in which a fluid, such as air, reductant, an air-reductant mixture, etc., may flow, either with or without intervening components or objects. Examples of fluid couplings or configurations for enabling fluid communication may include piping, channels, or any other suitable components for enabling the flow of a fluid from one component or object to another.

It is important to note that the construction and arrangement of the various systems shown in the various example implementations is illustrative only and not restrictive in character. All changes and modifications that come within the spirit and/or scope of the described implementations are desired to be protected. It should be understood that some features may not be necessary, and implementations lacking the various features may be contemplated as within the scope of the disclosure, the scope being defined by the claims that follow. When the language "a portion" is used, the item can include a portion and/or the entire item unless specifically stated to the contrary.

Also, the term "or" is used, in the context of a list of elements, in its inclusive sense (and not in its exclusive sense) so that when used to connect a list of elements, the term "or" means one, some, or all of the elements in the list. Conjunctive language such as the phrase "at least one of X, Y, and Z," unless specifically stated otherwise, is otherwise understood with the context as used in general to convey that an item, term, etc. may be either X, Y, Z, X and Y, X and Z, Y and Z, or X, Y, and Z (i.e., any combination of X, Y, and Z). Thus, such conjunctive language is not generally intended to imply that certain embodiments require at least one of X, at least one of Y, and at least one of Z to each be present, unless otherwise indicated.

Additionally, the use of ranges of values (e.g., W1 to W2, etc.) herein are inclusive of their maximum values and minimum values (e.g., W1 to W2 includes W1 and includes W2, etc.), unless otherwise indicated. Furthermore, a range of values (e.g., W1 to W2, etc.) does not necessarily require the inclusion of intermediate values within the range of values (e.g., W1 to W2 can include only W1 and W2, etc.), unless otherwise indicated.

What is claimed is:

1. An exhaust conduit assembly comprising:
an exhaust conduit body defining an exhaust flow path;
an injection aperture extending through the exhaust conduit body; and
a doser mount portion comprising:
an inlet port configured to receive a coolant,
a channel configured to receive the coolant from the inlet port, at least a portion of the channel extending around at least a portion of the injection aperture, the channel comprising a first portion and a second portion, and
an outlet port configured to receive the coolant from the channel;
wherein the doser mount portion defines a cavity configured to receive at least a portion of a dosing module and a ridge defines a base of the cavity; and
wherein the first portion of the channel is disposed adjacent to the cavity and the second portion of the channel is disposed adjacent to the ridge.

2. The exhaust conduit assembly of claim 1, wherein the doser mount portion is integrally formed with the exhaust conduit body.

3. The exhaust conduit assembly of claim 1, wherein at least the portion of the channel extends around an entirety of the injection aperture.

4. The exhaust conduit assembly of claim 1, wherein the inlet port and the outlet port are both disposed on a top face of the doser mount portion or both extend from a side of the doser mount portion.

5. The exhaust conduit assembly of claim 1, further comprising:
a support wall that at least partially defines an air gap, the support wall separating the channel from the air gap.

6. The exhaust conduit assembly of claim 5, wherein the air gap is defined by an inner wall and an outer wall, the inner wall being the exhaust conduit body, and the outer wall separated from inner wall by the support wall.

7. The exhaust conduit assembly of claim 6, wherein the outer wall extends around a portion of the inner wall.

8. The exhaust conduit assembly of claim 1, further comprising:
a first support wall at least partially defining a first air gap, the first support wall separating the first air gap from a first portion of the channel; and
a second support wall at least partially defining a second air gap, the second support wall separating the second air gap from a second portion of the channel;
wherein:
the exhaust conduit body comprises an inlet and an outlet;
the first air gap is disposed between the first portion and the inlet of the exhaust conduit body; and
the second air gap is disposed between the second portion and the outlet of the exhaust conduit body.

9. An exhaust aftertreatment system comprising:
a doser comprising an injector; and
the exhaust conduit assembly of claim 1;
wherein the doser is coupled to the doser mount portion such that the injector is configured to provide reductant through the injection aperture and into the exhaust conduit body.

10. The exhaust aftertreatment system of claim 9, wherein:
the doser mount portion defines a cavity extending around the injection aperture; and
a portion of the doser is received within the cavity.

11. An exhaust aftertreatment system comprising:
a doser comprising an injector;
an exhaust conduit assembly comprising:
an exhaust conduit body defining an exhaust flow path;
an injection aperture extending through the exhaust conduit body; and
a doser mount portion comprising:
an inlet port configured to receive a coolant,
a channel configured to receive the coolant from the inlet port, at least a portion of the channel extending around at least a portion of the injection aperture, and
an outlet port configured to receive the coolant from the channel; and
a turbocharger configured to receive the coolant and an exhaust;
wherein the turbocharger and the exhaust conduit assembly are configured such that the exhaust conduit assembly receives the exhaust from the turbocharger and the inlet port receives the coolant from the turbocharger; and
wherein the doser is coupled to the doser mount portion such that the injector is configured to provide reductant through the injection aperture and into the exhaust conduit body.

12. The exhaust aftertreatment system of claim 11, wherein the turbocharger includes a housing that is integrally formed with the exhaust conduit assembly.

13. An exhaust aftertreatment system comprising:
a doser comprising an injector;
an exhaust conduit assembly comprising:
an exhaust conduit body defining an exhaust flow path;
an injection aperture extending through the exhaust conduit body;
a doser mount portion comprising:
an inlet port configured to receive a coolant,
a channel configured to receive the coolant from the inlet port, at least a portion of the channel extending around at least a portion of the injection aperture, and an outlet port configured to receive the coolant from the channel;

an inner wall;

a support wall coupled to the inner wall and extending radially away from the inner wall; and an outer wall coupled to the support wall, the outer wall separated from the inner wall by the support wall such that an air gap extends between the outer wall and the inner wall; and a coolant pump configured to receive the coolant;

wherein the coolant pump and the exhaust conduit assembly are configured such that the coolant pump receives the coolant from the outlet port; and wherein the doser is coupled to the doser mount portion such that the injector is configured to provide reductant through the injection aperture and into the exhaust conduit body.

14. The exhaust aftertreatment system of claim 9, wherein:

the exhaust conduit assembly comprises:

an inner wall, a support wall coupled to the inner wall and extending radially away from the inner wall, and an outer wall coupled to the support wall, the outer wall separated from the inner wall by the support wall such that an air gap extends between the outer wall and the inner wall.

15. The exhaust aftertreatment system of claim 14, wherein the support wall separates the air gap from the channel.

16. The exhaust aftertreatment system of claim 9, further comprising:

a turbocharger configured to receive exhaust; and a coolant source configured to store the coolant;

wherein the exhaust conduit assembly receives the exhaust from the turbocharger; and wherein the exhaust conduit assembly receives the coolant from the coolant source.

17. An exhaust conduit assembly comprising:

an exhaust conduit body defining an exhaust flow path, the exhaust conduit body comprising an inlet and an outlet;

a support wall extending radially away from the exhaust conduit body;

an outer wall extending around a portion of the exhaust conduit body, the outer wall separated from the exhaust conduit body by the support wall;

an injection aperture extending through the exhaust conduit body; and a doser mount portion defining a cavity that extends around the injection aperture, the cavity to receive a portion of a doser;

wherein the exhaust conduit body, the support wall, and the outer wall define at least one air gap, the at least one air gap disposed between the doser mount portion and at least one of the inlet or the outlet of the exhaust conduit body.

18. The exhaust conduit assembly of claim 17, further comprising:

an inlet port configured to receive a coolant;

a channel configured to receive the coolant from the inlet port, at least a portion of the channel extending around at least a portion of the injection aperture; and an outlet port configured to receive the coolant from the channel.

19. The exhaust conduit assembly of claim 18, wherein the support wall separates the at least one air gap from the channel.

* * * * *